United States Patent [19]

Ikeda

[11] Patent Number: 4,476,595

[45] Date of Patent: Oct. 16, 1984

[54] MATTRESS FOR USE ON A BED AND SETTEE

[75] Inventor: Minoru Ikeda, Tokyo, Japan

[73] Assignee: France Bed Co., Ltd., Tokyo, Japan

[21] Appl. No.: 409,284

[22] Filed: Aug. 18, 1982

[30] Foreign Application Priority Data

Aug. 27, 1981 [JP] Japan ..... 56-126715[U]

[51] Int. Cl.[3] ..... A47C 23/04

[52] U.S. Cl. ..... 5/478; 5/267; 267/94; 267/95; 297/DIG. 2; 297/455

[58] Field of Search ..... 5/478, 464, 475, 267, 5/272, 274, 276, 262; 267/94, 95, 100, 101, 104, 105; 297/DIG. 2, 455, 456, 457

[56] References Cited

U.S. PATENT DOCUMENTS

| | | | |
|---|---|---|---|
| 1,525,675 | 2/1925 | Orman | 267/100 |
| 3,239,584 | 3/1966 | Terry | 5/487 |
| 3,576,040 | 4/1971 | Larsen | 5/478 |
| 3,906,560 | 9/1975 | Bulloch | 5/478 |
| 4,324,011 | 4/1982 | Cavaler | 5/475 |

FOREIGN PATENT DOCUMENTS

| | | |
|---|---|---|
| 47-39607 | 11/1972 | Japan . |
| 54-9456 | 5/1979 | Japan . |

*Primary Examiner*—Alexander Grosz
*Assistant Examiner*—Vinh Luong
*Attorney, Agent, or Firm*—Frishauf, Holtz, Goodman & Woodward

[57] ABSTRACT

A mattress for use on a bed and settee comprises a spring unit, at least one cushion, a protection layer arranged between the spring unit and the cushion, and an outer covering for covering these component members. The protection layer includes a frame located at the circumference and outside of the spring unit, and a net tensioned inside the frame, the protection layer being made of synthetic resin and having the frame and net formed integral thereto. The frame has a flange with which end turns of coil springs arranged in the spring unit and adjacent to the frame can be contacted. The frame of each protection layer provided with the flange has sufficient rigidity and serves as a reinforcing member.

9 Claims, 14 Drawing Figures

MATTRESS FOR USE ON A BED AND SETTEE

BACKGROUND OF THE INVENTION

The present invention relates to a mattress for use on a bed and settee.

Mattresses for use on beds and settees comprise a flat spring unit including a plurality of compression coil springs arranged side by side. A cushion made of foamed synthetic resin material such as polyurethane and urethane foams is arranged on at least one of upper and lower sides of the spring unit with a protection layer interposed between them. The protection layer serves to keep the hard metallic spring unit from touching the soft cushion so as to protect the cushion from being broken. These components are covered by an outer covering. A mattress having an arrangement like this must keep its effective useful area large by making its circumferential portion have the same rigidity as its center portion. The circumferential portion of the mattress is given the desired rigidity by arranging reinforcing members at the circumference of the spring unit and connecting the reinforcing members to the coil springs located at the circumference of the spring unit by clips. Load applied to the mattress when the user lies on the mattress is transmitted and distributed to the coil springs through the reinforcing members as well. Therefore, the reinforcing members make the circumference of the mattress hard and distribute the load as well. Urethane foam rods, steel wire frames and metal strips having a V-shaped section are employed as the reinforcing members. The protection layer for separating the spring unit from the cushion serves to assist the cushion in attaining its predetermined flexure curve, thus giving a feeling of appropriate hardness to the user. It is believed that the reinforcing members and protection layer are indispensable to the mattress.

The protection layer is usually made of sisal or cotton. When the mattress is used for a long time and subjected to loads repeatedly, the protection layer is likely to become permanently deformed. The correct flexure curve of the cushion is deflected, creating local hardness and discomfort. Protection layers made of steel wires are also used to prevent the permanent deformation thereof. However, the metallic protection layer is liable to break the cushion. Japanese Utility Model Publication Nos. 47-39607 (published on Nov. 30, 1972 with Nippon Bed Manufacturing K.K. as its applicant) and 54-9456 (published on May 2, 1979 with Izumi Manufacturing Corporation as its applicant) disclose net-like protection layers made of synthetic resin to eliminate the above-mentioned drawback. Net-like protection layers made of synthetic resin are the least likely to deform permanently and to break the cushion.

With conventional mattresses, the protection layers are usually connected to the reinforcing members by clips and thus prevented from shifting on the spring unit. However, clips are likely to break the outer covering and cushion because they partially project outward.

Conventional mattresses employ reinforcing members to give desired rigidity to the circumference thereof, as described above. In addition, the reinforcing members, spring unit and protection layers must be connected to one another by clips which creates the possibility that the outer covering and cushion may break. These reinforcing members and clips also make the mattress assembly inefficient.

SUMMARY OF THE INVENTION

It is an object of the present invention to provide a mattress for use on a bed and settee in which a protection layer also serve as a reinforcing member.

To this end, the present invention provides a protection layer sandwiched between a cushion and a spring unit and made of synthetic resin having a frame located at the circumference and outside of the spring unit with a net spread inside the frame. The frame includes a flange which is in contact with the ends of adjacent coil springs of the spring unit to prevent these coil springs from shifting sideward. This flanged frame has greater rigidity than the net, making the circumference of the mattress hard and the effective useful area thereof large. In addition, the adjacent coil springs are in contact with the flange of the frame. Sideward shift of the coil springs can thus be prevented by the flange of the frame. Load applied to the mattress is transmitted through the flange of the frame to the coil springs. The contact between the flange of the frame and the coil springs also serves to prevent the protection layer from shifting sideward. As apparent from the above, the frame of the protection layer also functions as conventional reinforcing member, thus allowing the reinforcing member and clips for connecting the reinforcing member to the protection layers to be omitted.

The and other objects and novel features of the present invention will more fully appear from the following detailed description when the same is read in connection with the accompanying drawings. It is to be expressly understood, however, that the drawings are for purposes of illustration only and are not intended as a definition of the invention.

DETAILED DESCRIPTION OF THE PREFERRED EMBODIMENTS

Figure 1:
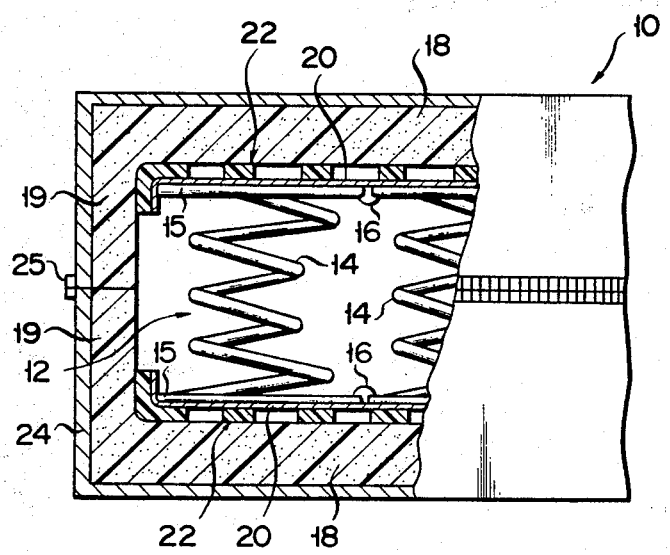
FIG. 1 is a fragmentary side view, partly in cross section, showing a first embodiment of a mattress according to the present invention.

As shown in FIG. 1, a mattress 10 of a first embodiment of the present invention comprises a spring unit 12. The spring unit 12 includes a plurality of compression coil springs 14 arranged side by side and connected flat to one another by helical wires 16. Cushions 18 made of foamed resilient material such as urethane foam are arranged on both upper and lower sides of the spring unit 12 and an unwoven cloth 20 and a protection layer 22 are sandwiched between the spring unit 12 and the cushion 18. The spring unit 12, unwoven cloths 20, protection layers 22 and cushions 18 are covered by an outer bag-shaped covering 24. The unwoven cloth 20 is not necessarily needed but serves, when added, to prevent friction sounds from being generated between the spring unit 12 and the protection layer 22 and also to prevent the cushion from being broken because of friction caused between the cushion 18 and the protection layer 22. A fastener 25 is attached along the circumference of the outer covering 24. The outer covering 24 thus provided with the fastener 25 allows the sewing process to be omitted in the course of mattress assembly. Each of cushions 18 is box-shaped with an integral circumferential wall 19. The mattress 10 shown in FIG. 1 is intended for use on a bed and has therefore the unwoven cloth 20, protection layer 22 and cushion 18 arranged on both upper and lower sides of the spring unit 12, respectively. When it is intended for use on a settee, however, the unwoven cloth, protection layer and cushions may be arranged only on one side of the spring unit.

Figure 2:
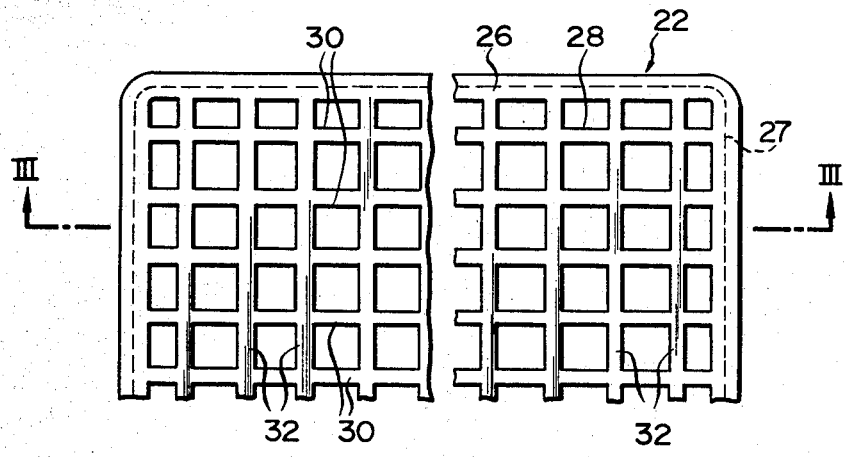
FIG. 2 is a fragmentary plan view showing a protection layer made of synthetic resin.
Figure 3:
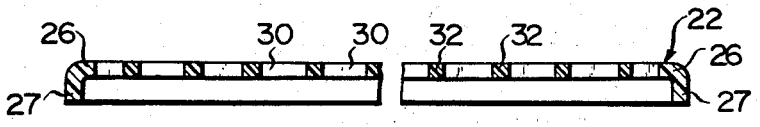
FIG. 3 is a sectional view taken along the line III—III in FIG. 2.

As apparent from FIGS. 2 and 3, the protection layer 22 is made of synthetic resin such as polypropylene and formed in a net-like shape. Namely, the protection layer 22 has a frame 26 located at the circumference and outside of the spring unit, and a net 28 spread inside the frame. The net 28 is provided with a plurality of longitudinal bars 30 and a plurality of transverse bars 32 crossing the longitudinal bars. Sections of the bars 30 and 32 need not be rectangular but may be circular or trapezoidal. The net 28 need not be rectangular in plane shape but may be rhombic. The frame 26 is provided with a flange 27 which is in contact with end turns 15 of the adjacent coil springs (see FIG. 1). Although this flange 27 extends vertically from the frame 26, the angle at which the flange 27 extends from the frame 26 is not limited to 90° but may be free if the end turns 15 of said coil springs are allowed to be in contact with the flange 27. With the mattress shown in FIG. 1, the end turns 15 of said coil springs contact the flange 27 with the unwoven cloth 20 interposed between them but may be in direct contact with the flange 27 without the unwoven cloth 20.

According to the mattress of the present invention as described above, the protection layer 22 is made of synthetic resin and includes the frame 26 and net 28 formed integral thereto. Since the flange 27 extends from the frame 26, the frame 26 serves as a resisting member against a load acting on the mattress 10 and also acting vertically on the protection layer 22, so that the frame 26 can create greater rigidity as compared with the net 28. Sufficient hardness is thus provided at the circumference of the mattress 10, giving the mattress 10 a large effective useful area. Since the frame 26 has sufficient rigidity, the protection layer 22 is reinforced by the frame 26, preventing the net 28 of the protection layer 22 from being locally deformed. Namely, the load acting on the protection layer 22 via the cushion 18 does not cause the net 28 to be bent but is distributed over the whole of the protection layer 22. Therefore, the heavy part of the user, his hip, does not sink deeply into the spring unit 12 but is supported on the mattress 10.

Since the coil springs 14 located at the circumference of the mattress 10 are in contact with the flange 27 of the frame 26, sideward shift of the coil springs 14 and protection layer 22 can be prevented. In addition, the frame 26 of the protection layer 22 includes the flange 27 so that the spring unit 12 may be easily located relative to the protection layer. Therefore, incorporation of the spring unit into the protection layers can be easily achieved. Further reinforcing members such as wire frames separate from the protection layers are unnecessary, thus allowing easy mattress assembly.

Figure 4:
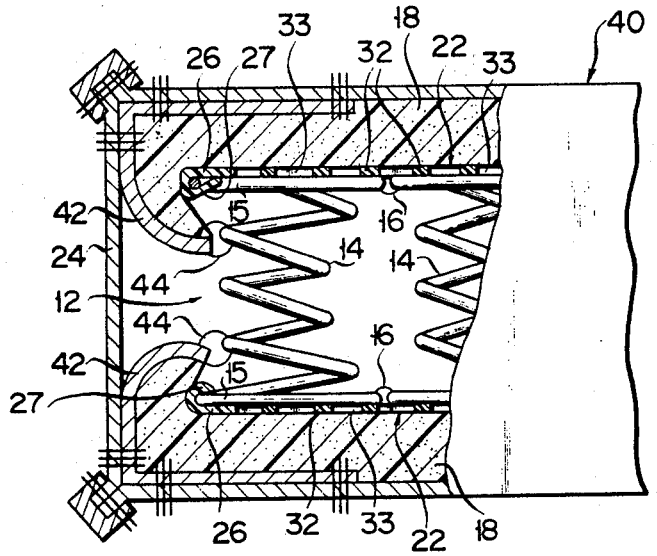
FIG. 4 is a fragmentary side view, partly in cross section, showing a second embodiment of a mattress according to the present invention.
Figure 5:
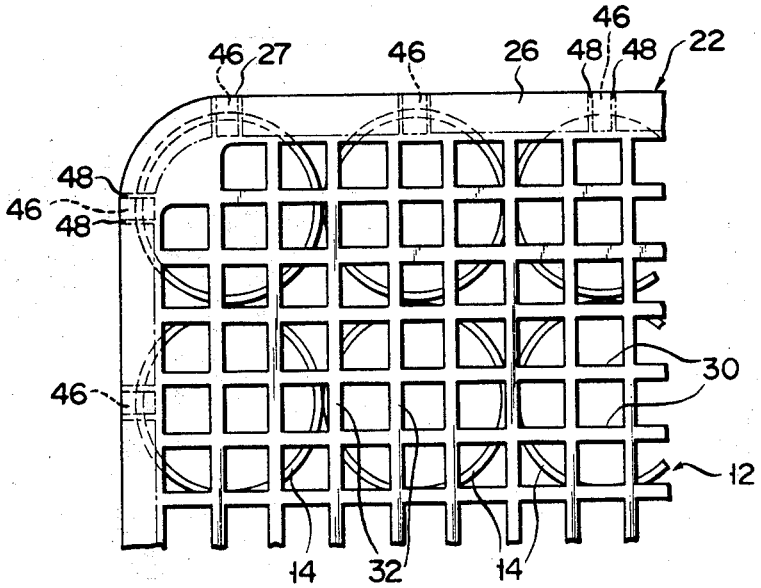
FIG. 5 is a fragmentary plan view showing the protection layer made of synthetic resin and a spring unit.

FIGS. 4 and 5 show a second embodiment of a mattress 40 according to the present invention. No unwoven cloth is arranged between the spring unit 12 and the protection layer 22 in the case of this mattress 40. The outer covering 24 consists of three sheets covering the upper, lower and side surfaces of the mattress 40 and sewed integral to one another. The circumferential edge of the cushion 18 is fixed to a flange cloth 42, which is sewed to the outer covering 24 at one end thereof while being connected to the circumferential coil springs 14 by clips 44 at the other end thereof.

Figure 6:
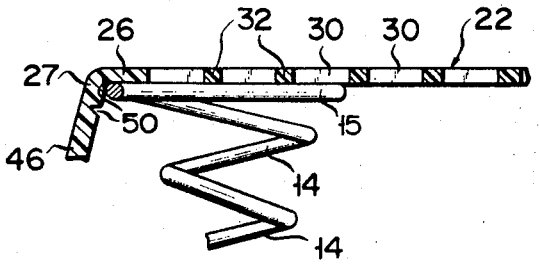
FIGS. 6 and 7 are fragmentary side views showing the protection layer and spring unit before and after the tongue-like portion of the protection layer is folded, respectively.
Figure 7:
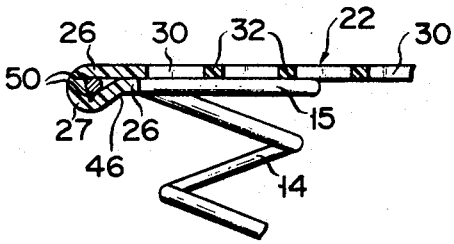
Figure 8:
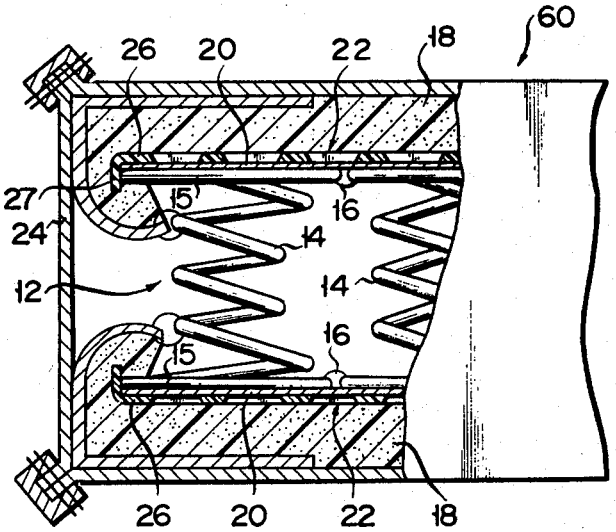
FIG. 8 is a fragmentary side view, partly in cross section, showing a third embodiment of a mattress according to the present invention.
Figure 9:
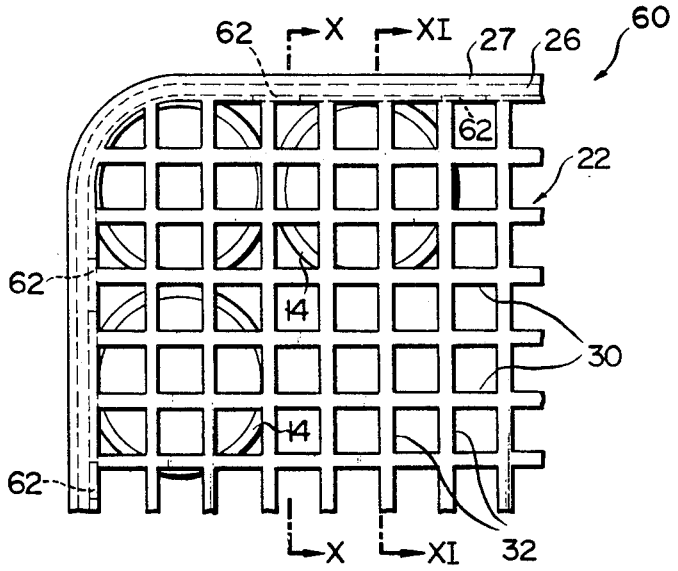
FIG. 9 is a fragmentary plan view showing a protection layer made of synthetic resin and a spring unit.

With the protection layers 22 employed by the second embodiment of the mattress 40, the flange 27 of the frame 26 is made freely folding, which is remarkably different from the first embodiment of the mattress 10. As apparent from FIG. 5, the flange 27 is formed of a plurality of pieces 46, but may be formed all along the circumference of the frame 26 with slits 48 spaced thereon, as shown by one-dot chain lines. The piece 46 is provided with notches 50 (see FIG. 6), making the flange 27 sufficiently folding. The tongue-like pieces 46 are bent and heat-sealed to the frame 26 sandwiching the end turns 15 of said circumferential coil springs 14.

As described above, the flange 27 of the frame 26 of the protection layer 22 is bent and heat-sealed to the frame 26 in such a way that the end turns 15 of the circumferential coil springs 14 are sandwiched between the flange 27 and the frame 26. Even if it is arranged like this, the frame 26 has greater rigidity than the net 28 and serves as a reinforcing member, so that the effective useful area of mattress can be kept large without using any reinforcing member, similar to the first embodiment of the mattress 10. In addition, the frame 26 sandwiching the end turns of said coil springs 14 can afford greater rigidity to the mattress 40 than in the first embodiment of the mattress 10. Further, sideward shift of the circumferential coil springs 14 and protection layers 22 can be prevented completely. Furthermore, the protection layer 22 made of synthetic resin can be connected by heat sealing and without using any clip to the frame 26 of the protection layer which serves as a reinforcing member relative to the spring unit 12. In short, the elimination of clips eliminates the possibility of damaging the cushions and makes mattress assembly easy.

Figure 10:
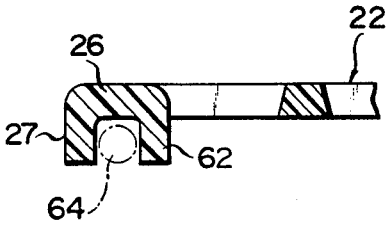
FIGS. 10 and 11 are sectional views taken along lines X—X and XI—XI in FIG. 9, respectively.
Figure 11:
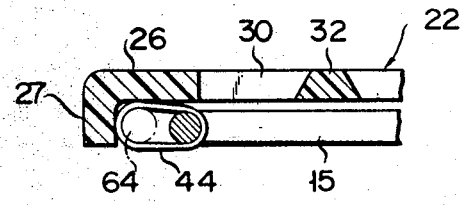

FIGS. 8 through 12 show a third embodiment of the mattress 60. With this mattress 60, the protection layers 22 are made of synthetic resin and each of their frames 26 has the flange 27 formed all along the circumference of the protection layer 22 and flange pieces 62 each extending vertically from the frame 26 and opposite to the flange 27 at a position corresponding to the contacted point of paired adjacent coil springs 14 (see FIGS. 9 and 10). However, the flange 27 need not be formed all along the circumference of the frame 26 but may be formed in pieces. Even if it is arranged like this, the frame 26 of the protection layer 22 has sufficient rigidity and serves as a reinforcing member, so that the effective useful area of the mattress can be kept large. The frame 26 functioning as a reinforcing member eliminates the need for any reinforcing member. In order to obtain greater rigidity, however, a reinforcing member such as steel frame wire 64, for example, may be arranged between the flange 27 and the flange pieces 62, as shown in FIG. 10. The frame wire 64 can be easily positioned in the horizontal direction by the flange 27 and flange pieces 62 and connected to end turns 15 of the adjacent coil springs 14 by clips 44 (see FIG. 11).

Figure 12:
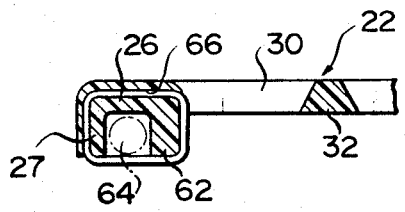
FIG. 12 is a fragmentary sectional view similar to FIG. 10 and showing a variation of a protection layer made of synthetic resin.

The clip 44 may be partly fitted into a groove 66 formed on the flange 27 and flange piece 62, as shown in FIG. 12. When it is arranged like this, the clip 44 does not extend outside the protection layer 22, so that neither cushions 18 nor outer covering 24 can be damaged by the clips 44.

Figure 13:
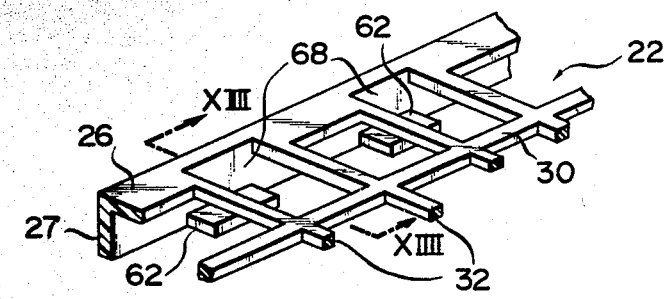
FIG. 13 is a perspective view showing another variation of a protection layer made of synthetic resin.
Figure 14:
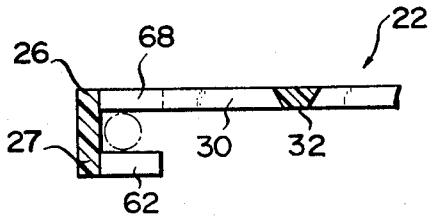
FIG. 14 is a sectional view taken along the line XIV—XIV in FIG. 13.

The flange pieces 62 may be extended not in the vertical but in a horizontal direction as shown in FIGS. 13 and 14. When the frame wire 64 is held by the vertically-extending flange 27 and horizontally-extending flange pieces 62, the engagement between the protection layer 22 and the frame wire 64 can be achieved reliably and their shift can be prevented in both vertical and horizontal directions. It is preferable in this case that cut-away portions 68 are formed in the frame 26 positioned above the horizontal flange pieces 62, as shown in FIG. 13. When the cut-away portions 68 are provided like this above the flange pieces 62, the die for protection layer 22 can be made simple.

What is claimed is:

1. A mattress for use on a bed and settee, comprising:

a spring unit including a plurality of compression springs arranged side by side and connected flat to one another, said spring unit having upper and lower surfaces;

a resilient cushion disposed on at least one of the upper and lower surfaces of the spring unit;

a protective layer disposed between the spring unit and the cushion so as to prevent the cushion from contacting the spring unit, said protective layer being integrally formed of a synthetic resin and including:

a frame located at the circumference and outside of the spring unit, a net stretched within the frame, and a flange extending substantially vertically from the frame to surround the periphery of the spring unit, said frame and flange being stiffer than said net so as to render the peripheral portion of said protective layer less susceptible to elastic deformation than said net; and an outer covering for covering the spring unit, cushion and protective layer.

2. A mattress according to claim 1 wherein the flange of the frame of said protection layer is provided with at least one notch so as to fold easily, and is folded and heat-sealed to the frame with end turns of said coil springs sandwiched within said folded layer.

3. A mattress according to claim 1 wherein the frame of said protective layer further includes flange pieces each extending from said frame at positions spaced from the flange and intermediate adjacent coil springs.

4. A mattress according to claim 1 wherein the frame of said proection layer further includes tongue-like flange pieces extending horizontally from its flange.

5. A mattress according to claim 4 wherein the protection layer is provided with cut-away portions formed in the frame thereof above the horizontal flange pieces.

6. The mattress of claim 1, further comprising a flange cloth, and means for wiring said springs to said cloth.

7. The mattress of claim 1, further comprising means for wiring said springs only to each other.

8. The mattress of claim 3, wherein said flange pieces are disposed parallel to the flange and extend in the same direction from said protection layer.

9. The mattress of claim 3, wherein said flange pieces extend perpendicularly from said flange of said frame and are parallel to and spaced from said net.

* * * * *